United States Patent [19]

Werner

[11] 4,070,082

[45] Jan. 24, 1978

[54] INSULATION PIERCING TAP FOR FLAT WIRE

[75] Inventor: Walter Myers Werner, Downingtown, Pa.

[73] Assignee: AMP Incorporated, Harrisburg, Pa.

[21] Appl. No.: 759,204

[22] Filed: Jan. 13, 1977

[51] Int. Cl.[2] ..... H01R 7/04
[52] U.S. Cl. ..... 339/98; 339/247
[58] Field of Search ..... 339/97–99, 339/95, 247, 273

[56] References Cited

U.S. PATENT DOCUMENTS

| | | | |
|---|---|---|---|
| 1,801,277 | 4/1931 | Kelley | 339/247 |
| 2,353,778 | 7/1944 | Mattis | 339/98 |
| 3,071,750 | 1/1963 | Heselwood | 339/97 R |
| 3,644,875 | 2/1972 | O'Loughlin | 339/97 R |

*Primary Examiner*—Joseph H. McGlynn
*Attorney, Agent, or Firm*—Allan B. Osborne

[57] ABSTRACT

The present invention discloses a device for connecting two flat insulated wires. The device includes a body member having an opening therethrough and a wedge member. The sides of the opening have a sharp ridge so that as the wedge squeezes the wires against the sides, the teeth pierce the insulation to make electrical contact.

2 Claims, 5 Drawing Figures

INSULATION PIERCING TAP FOR FLAT WIRE

BACKGROUND OF THE INVENTION

Flat wire such as used in certain kinds of transformers present difficulty in their splicing together. Accordingly the object of the present invention is to provide a device which quickly and reliably electrically connects and mechanically retains two or more flat wires without the need to remove the insulation.

Another object of the present invention is to provide a device which can splice two or more wires together using only a pair of pliers or any other mechanical means.

DESCRIPTION OF THE PRESENT INVENTION

Figure 1:
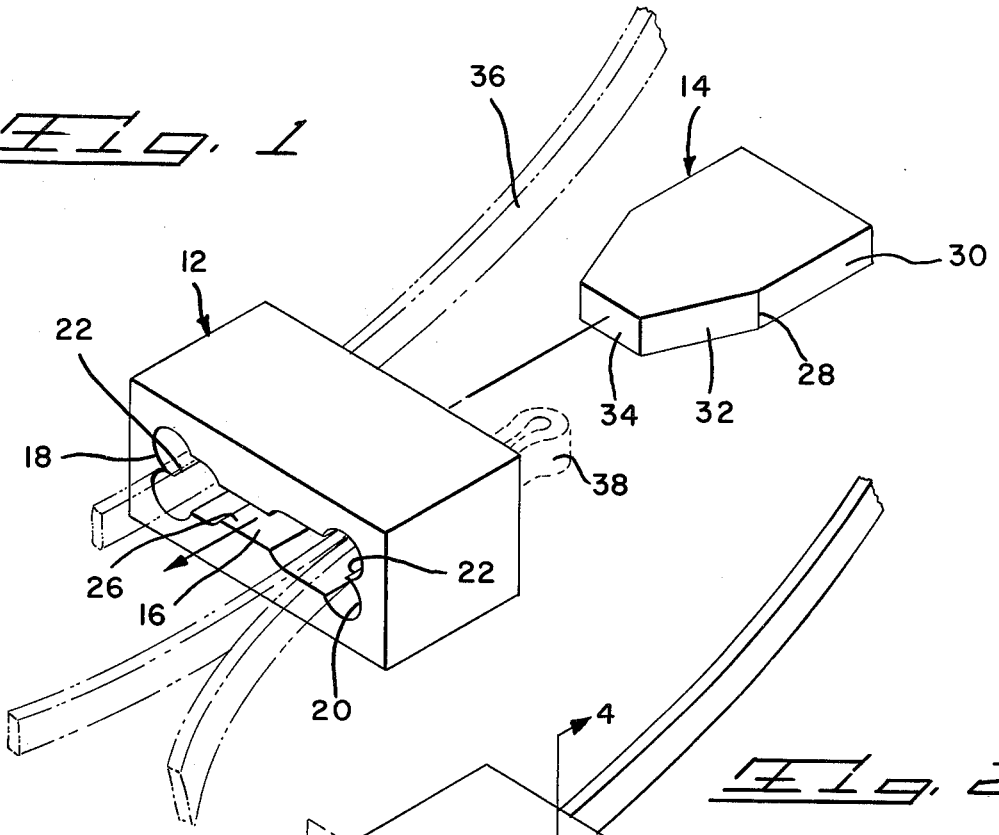
FIG. 1 is a perspective view of the present invention prior to interconnecting a pair of insulated flat wire.

The device 10 of the present invention as shown in FIGS. 1—4 includes a body member 12 and a wedge member 14. Both are preferably made from aluminum with the body member being extruded and the wedge member being stamped.

Body member 12 may be rectangular although any suitable external shape could be employed. Opening 16, which extends through the body member, has a complex shape. Its two sides 18 consist of two arcuate grooves 20 with an inwardly pointing tooth or sharp ridge 22 in between.

Inwardly from the sides, the top and bottom surfaces 24 converge toward the center. A median strip 26, occupying about one third of each surface 24, denotes the narrowed portion of the opening. Wedge member 14 is essentially a rectangular block whose two sides 28 are divided into a rear straight section 30 and a front beveled section 32. The beveled section provides a nose 34 to facilitate insertion of the wedge member into opening 16. The thickness of the block is about equal to the height of the openong 16 between median strips 26 so that upon insertion, there is an interference fit.

The procedure to interconnect two wires 36 and 38 requires placing the wires through the openings 16 and against sides 18, as shown in FIG. 1. The wires are in phantom so as not to mask details of opening 16. Wire 38 is looped because the prototype device pictured in the drawings was too large for the thickness of the particular wire used. Such wire is insulated by a coating of varnish.

Figure 2:
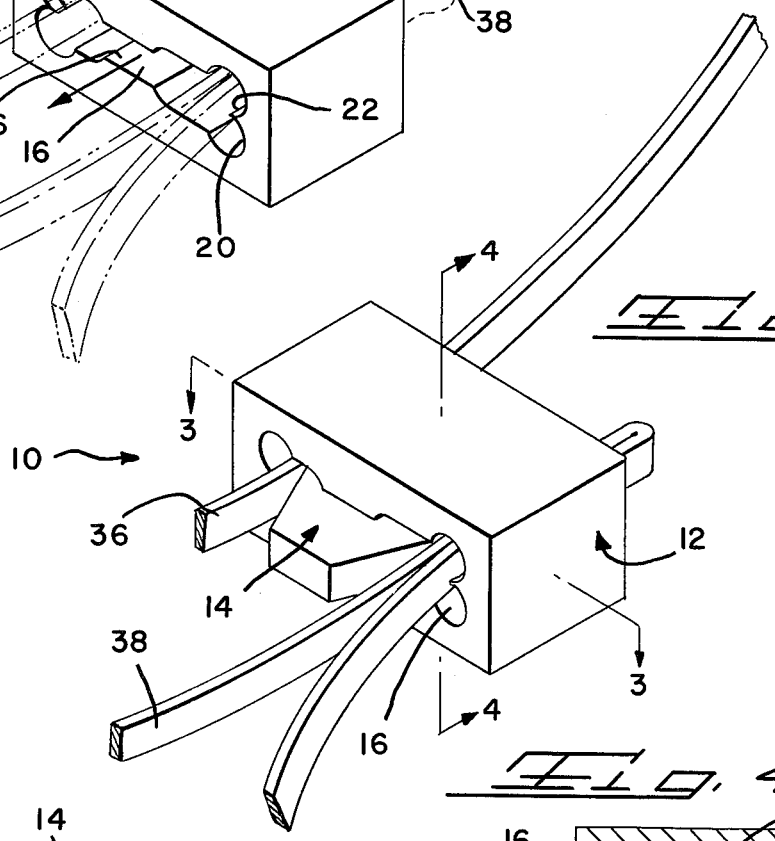
FIG. 2 is a perspective view of the device of FIG. 1 following the interconnecting of the pair of wires.
Figure 3:
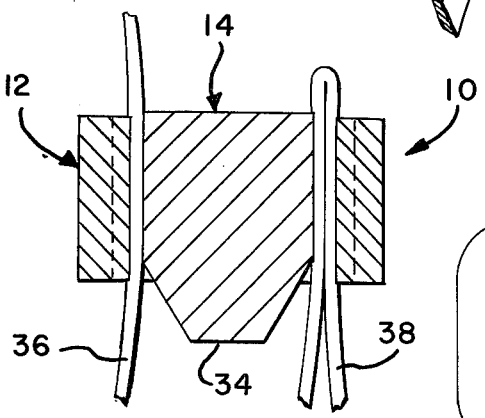
FIGS. 3 and 4 are cross-sectional views taken along lines 3—3 and 4—4 respectively in FIG. 2.
Figure 4:
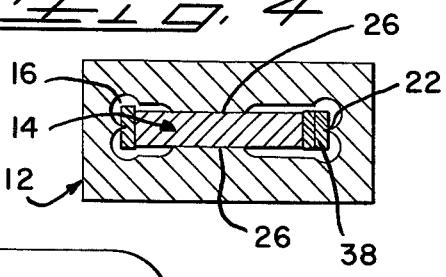

The nose 34 of wedge member 14 is started into opening 16 by hand while holding the wires flat against ridges 22. Thereafter the wedge member is driven as deep into the opening as possible by use of a pair of pliers. As this is being done, the wires are pressed against the ridges so that the sharp point thereon cuts through the insulation and makes contact with the underlying conductor. The final assembly is shown in FIGS. 2–4. The straight sections 30 of the wedge member occupy most of the length of the opening.

Figure 5:
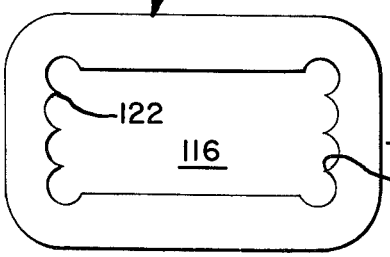
FIG. 5 is an end view of another embodiment of the body member of the present invention.

FIG. 5 is a frontal view of another embodiment of the present invention. Body member 112 has an enlarged opening 116 with a plurality of ridges 122. The plurality of ridges provides multiplicity of contact points which in turn enhances the electrical interconnection.

The sides 18 of opening 16 and 116 are grooved so as to provide clearance for wider wires.

The foregoing detailed description has been given for clearness of understanding only, and no unnecessary limitations should be understood thereform, as some modifications will be obvious to those skilled in the art.

What is claimed is:

1. A device for mechanically retaining and electrically interconnecting two insulated wires, comprising:

a. a body member of conductive material having an opening with parallel sides therethru with at least one inwardly projecting ridge on each side thereof running the length of the opening, said ridges having a sharp point thereon; and b. a wedge member of conductive material having a beveled front section and a straight rear section and adapted to be driven into the opening of the body member so that the straight rear section squeezes the wires which may be positioned therein against the ridges whereby the sharp points thereon cut thru the insulation and make electrical contact with the underlying conductors.

2. The device of claim 1 wherein the top and bottom surfaces of the opening converge towards the center thereof so that the opening is narrower in the center portion and larger at either side.

* * * * *